US009808846B2

(12) United States Patent
Mazzocchi

(10) Patent No.: US 9,808,846 B2
(45) Date of Patent: Nov. 7, 2017

(54) LOCKING DEVICE FOR LOCKING TOOLS IN A PRESS BRAKE

(71) Applicant: ROLLERI S.P.A., Vigolzone (PC) (IT)

(72) Inventor: Domenico Mazzocchi, Vigolzone (IT)

(73) Assignee: ROLLERI S.P.A., Vigolzone (PC) (IT)

( * ) Notice: Subject to any disclaimer, the term of this patent is extended or adjusted under 35 U.S.C. 154(b) by 0 days.

(21) Appl. No.: 14/916,661

(22) PCT Filed: Sep. 15, 2014

(86) PCT No.: PCT/IB2014/064524
§ 371 (c)(1),
(2) Date: Mar. 4, 2016

(87) PCT Pub. No.: WO2015/036981
PCT Pub. Date: Mar. 19, 2015

(65) Prior Publication Data

US 2016/0193642 A1 Jul. 7, 2016

(30) Foreign Application Priority Data

Sep. 13, 2013 (IT) ..... PC2013A0024

(51) Int. Cl.
*B21D 37/04* (2006.01)
*B21D 5/02* (2006.01)

(52) U.S. Cl.
CPC ..... *B21D 5/0236* (2013.01); *B21D 5/02* (2013.01); *B21D 5/0209* (2013.01)

(58) Field of Classification Search
CPC ..... B21D 5/0236; B21D 5/0209; B21D 5/02
(Continued)

(56) References Cited

U.S. PATENT DOCUMENTS 5,022,256 A * 6/1991 van der Meulen .. B21D 5/0236 269/238
5,507,170 A 4/1996 Kawano
(Continued)

FOREIGN PATENT DOCUMENTS

CN 1125647 A 7/1996
CN 1402657 A 3/2003
(Continued)

OTHER PUBLICATIONS

International Search Report, dated Nov. 14, 2014, from corresponding PCT application.

*Primary Examiner* — David B Jones
(74) *Attorney, Agent, or Firm* — Young & Thompson

(57) ABSTRACT

A locking device for locking tools in a press brake includes a first jaw (2) and a second jaw (3), movable towards and away from each other, and at least one safety hook (4) interposed there between provided with a retaining tooth (41) adapted to be inserted into a groove (52) defined in the shank (51) of a tool (5), wherein on an inner side (35) of the second jaw (3) facing the first jaw (2) there is provided at least one thrust surface (36) adapted to cooperate with, while resting slidingly against, at least one corresponding rest surface (43) on an outer side (42) of the safety hook, the thrust surface (36) and the rest surface (43) lying substantially parallel along a thrust plane (P) sloping in the opposite direction to the first jaw (2) by an angle (α) of between 30° and 60° with respect to a vertical plane.

16 Claims, 10 Drawing Sheets

(58) Field of Classification Search
USPC ..... 72/482.91
See application file for complete search history.

(56) References Cited

U.S. PATENT DOCUMENTS

| | | | | | |
|---|---|---|---|---|---|
| 5,572,902 | A * | 11/1996 | Kawano | B21D 5/0236 | 72/389.3 |
| 6,138,492 | A * | 10/2000 | Vining | B21D 5/0236 | 72/389.3 |
| 6,644,090 | B2 * | 11/2003 | Gasparini | B21D 5/0236 | 72/481.1 |
| 8,099,992 | B2 * | 1/2012 | Rouweler | B21D 5/0209 | 72/389.3 |
| 9,555,456 | B2 * | 1/2017 | Rogers | B21D 5/0245 | |
| 2004/0187552 | A1 | 9/2004 | Enderink | | |

FOREIGN PATENT DOCUMENTS

| | | | |
|---|---|---|---|
| EP | 1 244 528 | B1 | 10/2002 |
| EP | 1 884 298 | A1 | 2/2008 |
| EP | 1 884 298 | A1 | 6/2008 |
| WO | 2010/056110 | A1 | 5/2010 |
| WO | 2011/092558 | A1 | 8/2011 |
| WO | 2011/141774 | A1 | 11/2011 |

* cited by examiner

LOCKING DEVICE FOR LOCKING TOOLS IN A PRESS BRAKE

BACKGROUND OF THE INVENTION

Field of the Invention

The present invention relates to a device for locking tools in a press brake, and in particular to a press for bending sheet metal or the like.

Description of the Related Art

In the machine tool sector, press brakes configured to give certain bending angles to metal sheets, plates or the like, through cold deformation, are well know.

Press brakes generally consist of a bottom bed defining a fixed surface on which to place the metal sheet and carrying a bending die according to the profile of which said metal sheet is bent.

An upper beam is supported so that it can move towards and away from the bed, along a substantially vertical plane. The beam carries integral therewith a bending tool adapted to cooperate with the die to give the sheet the desired shape.

Movement of the upper beam is generated by hydraulic, mechanical or electrical actuator means, which provide the necessary force for the deformation operation.

The tool generally has a lower end structured to cooperate with the upper surface of the die and an upper portion defining a shank for attaching to the upper beam.

As a function of the type of machining to be carried out, said tool can be single, i.e. with a monolithic body that extends for the whole, or for a part, of the length of the crossbeam, or divided into parts, i.e. consisting of several parts placed side by side in the direction of extension of the crossbeam.

For this purpose, the upper beam can be provided with one or more locking devices (known in the field as "intermediate devices") that, clamping the shanks of the tools, make them integral therewith to enable pressing.

Among the various shapes and types of shank, some of the more widely used have become standardized shapes to enable tools to be installed on presses of different manufacturers.

According to a very widely used variant, the shank has on at least one side a seat, with a C-shaped grooved profile, in which a retaining tooth of the locking device engages to prevent the tool from slipping out and falling when the locking device is loosened.

Prior art locking devices are generally structured like a clamp and comprise a fixed jaw integral with the upper beam and a movable jaw moved by a closing device adapted to move the movable jaw towards or away from the fixed jaw to clamp or release the tool.

A common problem that occurs in the use of these devices concerns the tool change operations.

There are essentially two methods for inserting and removing the tools in prior art locking devices, as a function of their configuration: by sliding the tool horizontally (parallel to the upper beam) or from below through a combined movement of translation and rotation.

In the first case, the tool is inserted at the sides of the press and is made to slide along the length of the upper beam to the predetermined operating position. This method has some drawbacks, the greatest of which is given by the difficulty and the long implementation times of the operation, which requires long machine stoppages.

Moreover, if the tool mounted on the machine comprises several elements placed side by side, to remove or replace an intermediate element it is necessary to first remove all those that precede it, with a further increase in the time required for replacement.

For these reasons locking devices in which the tool can be inserted from the bottom upwards are preferable as, besides requiring much less time to install or remove a single tool, they also allow an intermediate tool to be replaced without having to remove or shift those that are close to it already installed.

EP 1 244 528 B1 describes a locking device for locking tools in which the movable jaw is provided with a lower tooth, facing the fixed jaw, which rests on a plurality of springs fixed on a protrusion of the same number of safety hooks, on which it exerts, through said springs, the force required to clamp the tool and cause it to rest against the fixed jaw.

The movable jaw is also provided with an upward facing upper tooth, which defines a cavity for insertion of a corresponding spike, projecting from the back of the safety hooks, which enables said safety hooks to remain suspended during clamping or release of the jaws.

This prior art locking device has some problems. A first drawback concerns the production of the teeth on the jaw and of the corresponding spikes and protrusions on the safety hook. These parts in fact require particularly laborious and costly precision machining.

Another problem of this device consists in the fragility of the safety hooks that, having a thin and elongated shape and being subject to continuous knocks against the shank of the tool during operations for insertion and removal of the insert, through time can become deformed or break.

Another problem of the device described above consists in the use of springs to transmit the clamping force from the lower tooth of the movable jaw to the safety hook. In particular, the flat springs, applied to the extrados of the hook, after a certain number of clamping and release cycles can yield or even break.

EP 1 884 298 B1 describes a locking device comprising a first jaw and a second jaw, movable in relation to each other, and safety hooks interposed between the first and the second jaw, provided with a retaining tooth adapted to be inserted into a cavity provided in the shank of the tool. The second jaw is provided with a seat in which said safety hooks are movably housed, said seat being closed, on the opposite side with respect to said first jaw, by an arc-like wall that cooperates, by elastic deformation, with a portion of the safety hook during clamping and release of the second jaw. The seat of the second jaw also houses a transverse bar that engages a claw-like portion of the safety hook to support it inside said seat.

This device also has a highly complex construction, due both to the shape of the safety hook and to the large number of parts to be assembled. Moreover, with this device the clamping force is transferred to the tool through an elastic element that may be prone to breaking after a large number of clamping and release cycles of the device. Moreover, this elastic element must be designed and calibrated to operate correctly both with small and light tools and with very heavy tools.

WO 2011/141774 describes a device for locking tools provided with a movable jaw on which there is obtained a tooth adapted to engage the shank of the tool to maintain it suspended and prevent it from falling when jaw is open.

Said tooth, guided along a clamping path of the jaw, also enables the tool to be taken to rest against the fixed jaw to maintain it in position during bending.

A common characteristic of the aforesaid devices, and of many other prior art devices, is the combination of movements to be imparted on the tool to be able to remove it from the locking device.

More in detail, in prior art devices, disengagement of the shank from the retaining tooth takes place following a rotation of the tool, at times aided by an upward translation. In general, rotation is imparted by pushing the tool in the lower part, located in front of the movable jaw, or otherwise by pulling it toward you.

During rotation the tool is gripped by the operator who, to terminate extraction, subsequently draws it downwards to release the shank completely.

Typically, rotation of the tool alone does not cause immediate disengagement of the shank; however, an accidental knock against the tool, for example during the machine set-up operations, in many cases may suffice for the grooved profile to pass beyond the retaining tooth, causing the tool to fall.

Considering the weight of some tools, which can exceed 25 kg, these episodes are dangerous for the operator in charge of the machine and for any other person in the vicinity thereof.

SUMMARY OF THE INVENTION

In this context the object of the present invention is to create a locking device for locking tools in a press brake, which overcomes the problems of the prior art mentioned above.

In particular, an object of the present invention is to create a locking device for locking tools in a press brake that enables the tools to be maintained suspended in the jaws both during the clamping step and during the release step thereof, ensuring the necessary safety conditions for operators in charge of tool changes.

More in detail, an object of the present invention is to provide a locking device for locking tools in a press brake capable of maintaining the tool constrained, and thus prevent it from falling, even if it is subject to impacts or accidental knocks.

Yet another object of the present invention is to create a locking device for locking a tool in a press brake that is simple to create, inexpensive to manufacture and as sturdy and reliable as possible.

One more object of the present invention is to create a locking device for locking tools in a press brake that enables the tool change operations to be carried out rapidly and effortlessly by the operator in charge.

The objects indicated above are achieved by the locking device for locking tools in a press brake of the present invention, which comprises a first jaw and a second jaw, movable towards and away from each other, and at least one safety hook interposed between said first and said second jaw. The safety hook is provided with a retaining tooth adapted to be inserted into a groove defined in the shank of a tool. On an inner side of said second jaw, facing the first jaw, there is obtained at least one thrust surface adapted to cooperate with, while resting slidingly against, at least a corresponding rest surface obtained on an outer side of the safety hook. Said thrust surface and said rest surface lie substantially parallel along a thrust plane sloping in the opposite direction to the first jaw by an angle of between 30° and 60° with respect to a vertical plane.

The safety hook, following clamping or release of the jaws, can therefore translate along a direction parallel to the thrust plane. By virtue of the arrangement of the thrust plane, this direction has a vertical component and a horizontal component of movement. The safety hook can therefore move both vertically and towards and away from the movable jaw.

When the jaws are clamped, the safety hook can draw the tool to take it to rest against the first jaw while, on the contrary, when they are released, it can slide along the thrust plane maintaining the retaining tooth engaged safely in the groove of the shank of the tool.

Moreover, when the jaws are released, due to the force of gravity the safety hook remains in a lowered position in which it can easily engage the shank of a tool that is inserted into locking device from the bottom upwards.

The clamping force that receives the tool is transmitted by means of two non-deformable elements, the second jaw and the safety hook, positioned in contact with each other. This ensures perfect positioning of the tool in the jaws also when it is subject to the considerable forces generated during operations to deform the sheet metal.

In a preferred aspect of the invention, the angle of the thrust plane is between 45° and 50° with respect to a vertical plane. In fact, these angles enable the frontal dimensions (thickness) of the locking device to be minimized.

In another aspect of the invention the safety hook is provided with a guide element adapted to guide the safety hook along the thrust plane. In practice, the guide element prevents rotations of the safety hook with respect to the second jaw. The safety hook is therefore substantially constrained to translation along a direction parallel to the thrust plane. In this way, the thrust and resting surfaces remain parallel to and in contact with each other, preventing jamming of the safety hook both during the step to clamp of the tool and during its removal.

In a preferred variant the guide element can comprise a slider adapted to slide in a seat obtained on the inner side of the second jaw.

In another aspect of the invention, on the inner side of the second jaw there are obtained a plurality of thrust surfaces. Said surfaces lie on the same number of thrust planes parallel to and staggered from one another along a substantially vertical direction. Likewise, on the outer side of the safety hook there are obtained a same number of resting surfaces, resting slidingly on a corresponding thrust surface.

Preferably said thrust and resting surfaces are between two and six in number and, even more preferably equal to three.

The thrust surfaces thus arranged enable the total sliding and thrust surface between the second jaw and the safety hook to be increased while limiting the horizontal dimensions both of the safety hook and of the second jaw.

A greater thrust surface also enables a reduction in the contact pressure between the surfaces of the jaw and of the safety hook, thereby reducing wear.

Finally, the staggered position of the resting surfaces enables the clamping forced to be transferred to the shank of the tool evenly along its vertical extension.

In yet another aspect of the invention, the safety hook is provided with a cantilever portion, projecting towards the first jaw. This cantilever portion is provided with a lower face (45*a*) sloping by an angle β of between 80° and 110° with respect to a vertical abutment plane located on an inner side of the safety hook.

The cantilever portion acts as an abutment for extraction of the tool, and in particular for disengaging the retaining tooth from the shank. In fact, the tool can be pushed upwards causing the safety hook to translate along the thrust plane towards the second jaw and subsequently translated horizontally towards the first jaw to release the retaining tooth. During this second step the head of the shank can slide along the lower face of the cantilever portion.

Preferably, the angle β is around 90°. In this case the tool translates along a practically horizontal direction when it is pushed towards the first jaw during the release and removal operation.

In another aspect of the invention, in the second jaw there is obtained at least one seat, inserted into which is a through positioning pin, one end of which is fixed to the safety hook. The seat is preferably a slot that constrains the hook to lateral translation (observing the locking device from the front) while it enables vertical translation and sliding along the thrust plane.

In another aspect of the invention, the device comprises retaining means that act on the safety hook to slow the downward movement thereof away from the second jaw.

Said retaining means comprise an elastic means housed in a seat obtained in the second jaw adapted to exert a force along a direction parallel to the thrust plane. Said elastic means rests on a head of a pin integral with the safety hook and housed at least partly in the seat.

In another aspect of the invention, the locking device comprises guide pins housed in through holes obtained in the second jaw adapted to guide said second jaw towards or away from the first jaw. These holes have a larger dimension with respect to the guide pins so that the second jaw can undergo slight vertical movements with respect to the first jaw.

At least one elastic means is housed in the second jaw and acts on the guide pins to maintain said second jaw in a raised position in which the guide pins contact the lower edge of the respective holes.

Said elastic means can comprise a spring inserted in a seat that extends until intercepting the hole that houses the pins. One end of the spring can thus contact the guide pin.

BRIEF DESCRIPTION OF THE DRAWING FIGURES

Further characteristics and advantages of the present invention will become more apparent from the indicative, and therefore non-limiting, description of an example of a preferred but not exclusive embodiment of a locking device for locking tools in a press brake, as illustrated in the accompanying drawings, in which.

Figure 1:
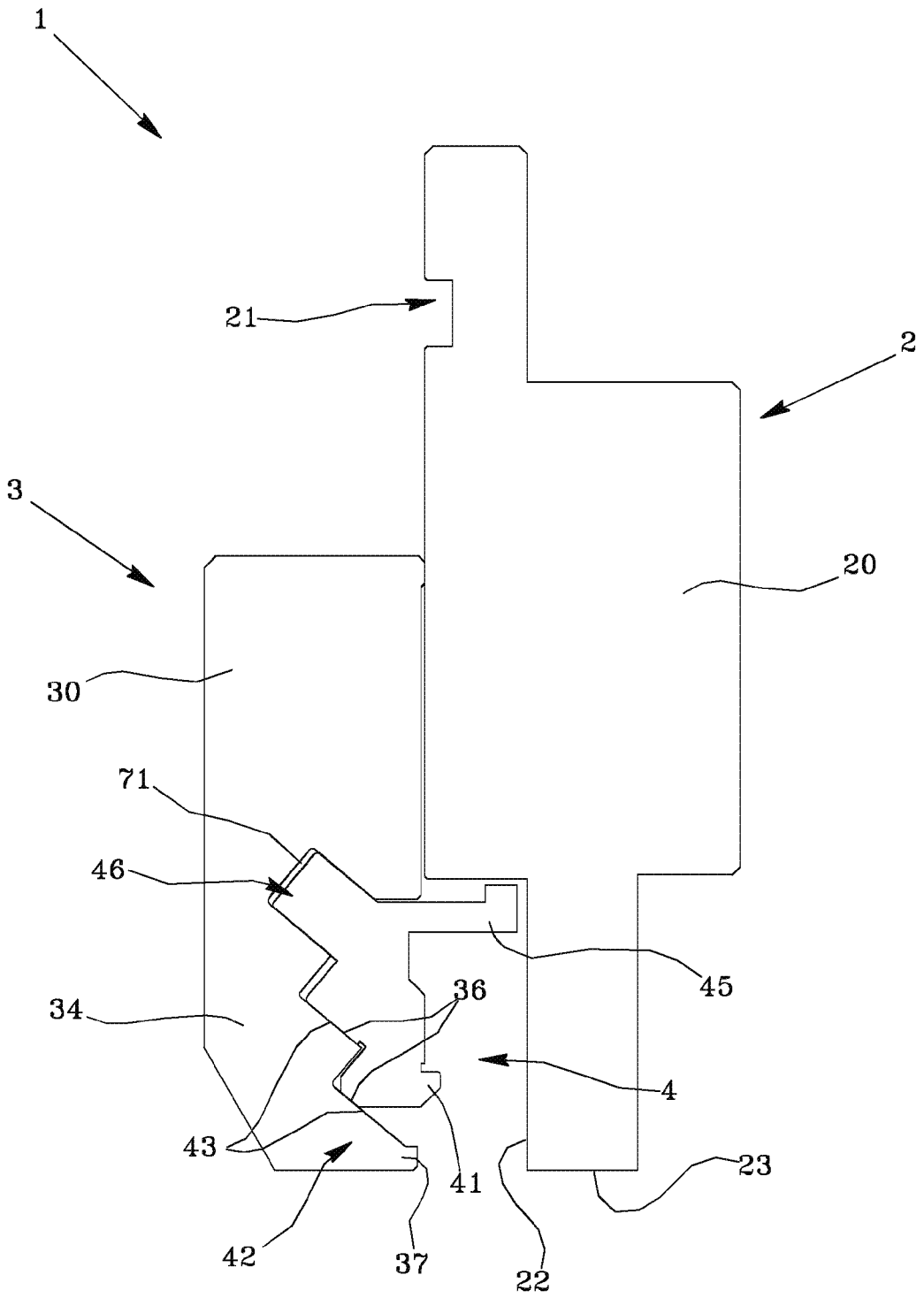
FIG. 1 is a side view of a locking device according to the invention.
Figure 12:
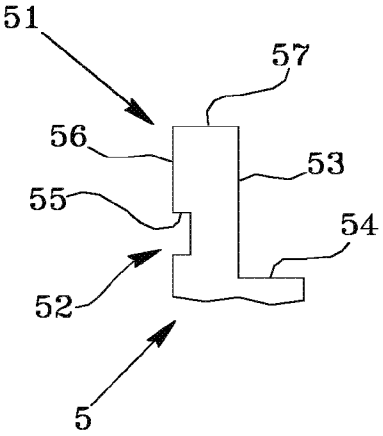
Figure 2:
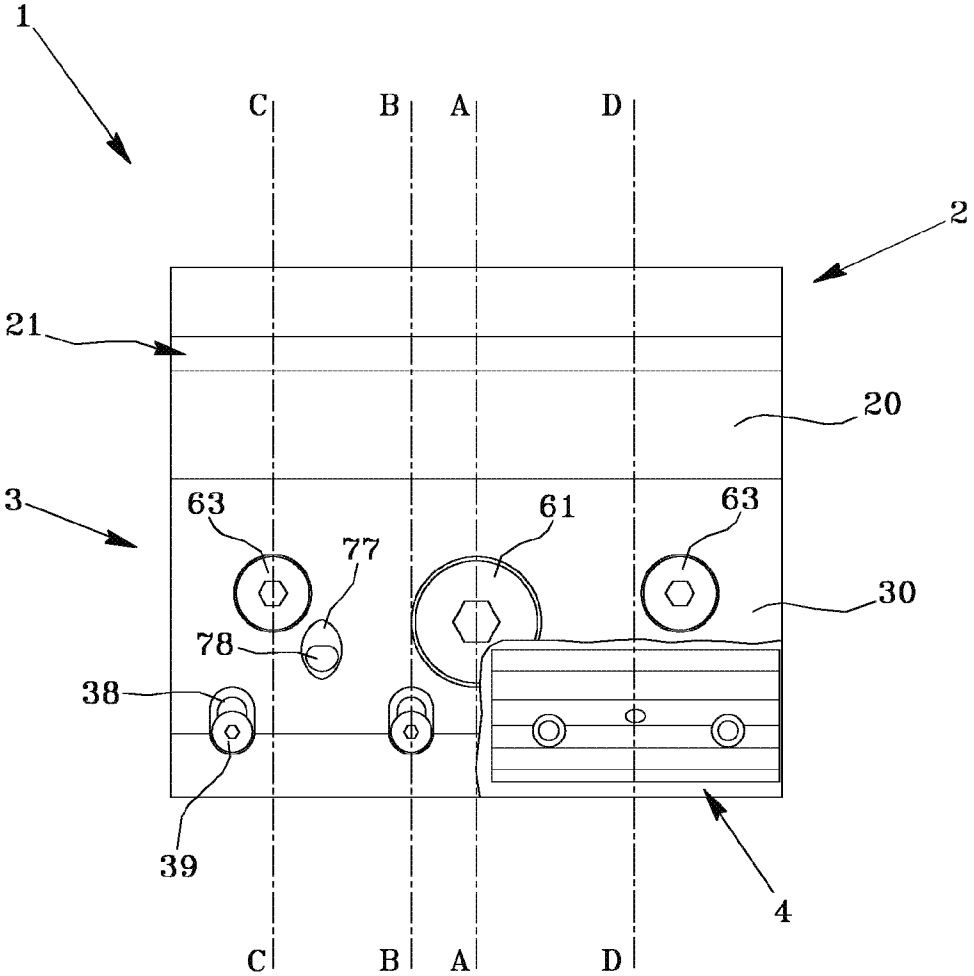
FIG. 2 is a partly sectional front view of the locking device according to the invention.
Figure 3:
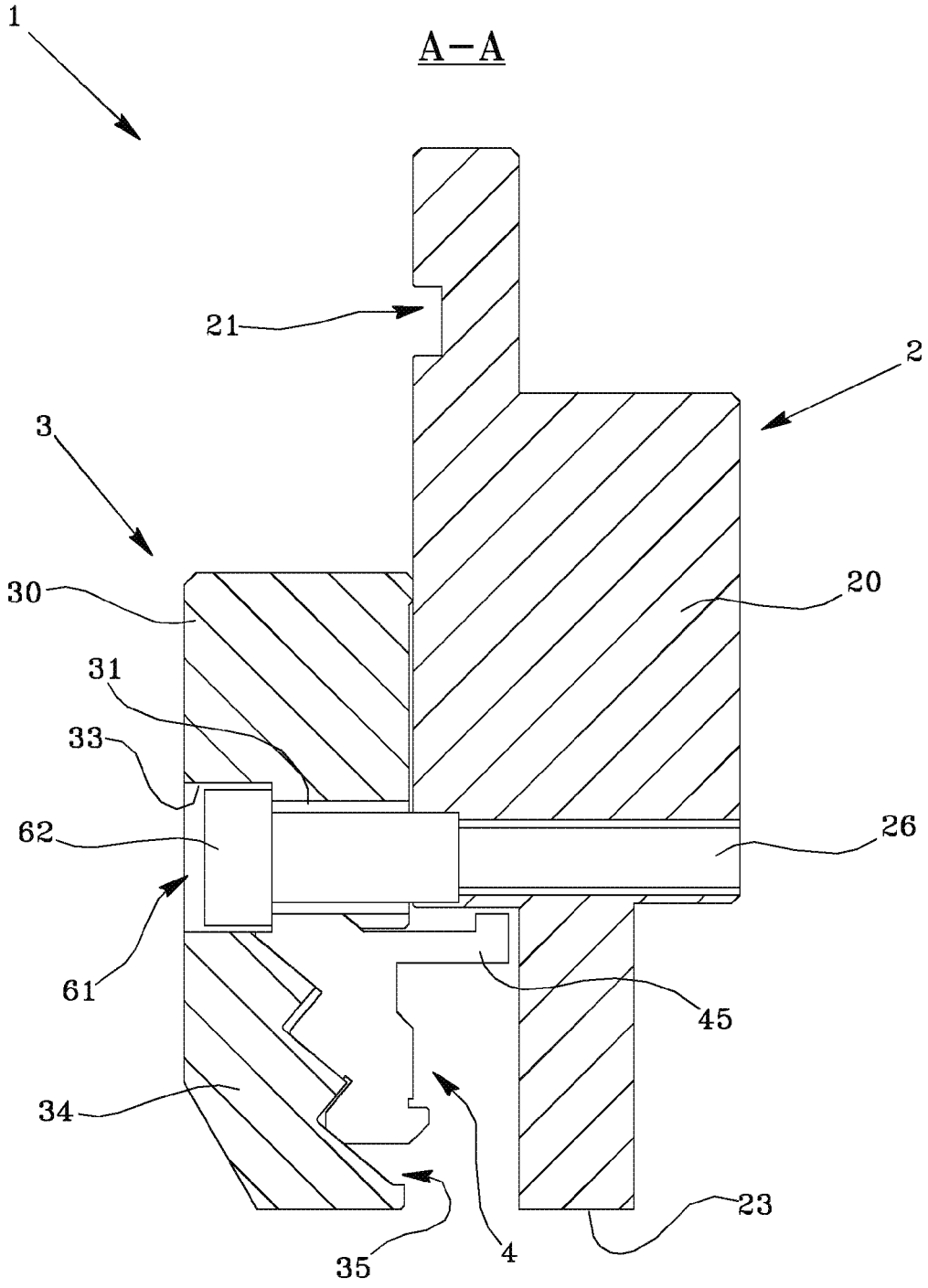
FIG. 3 is a sectional side view, along a vertical plane A-A, of the locking device according to the invention.
Figure 4:
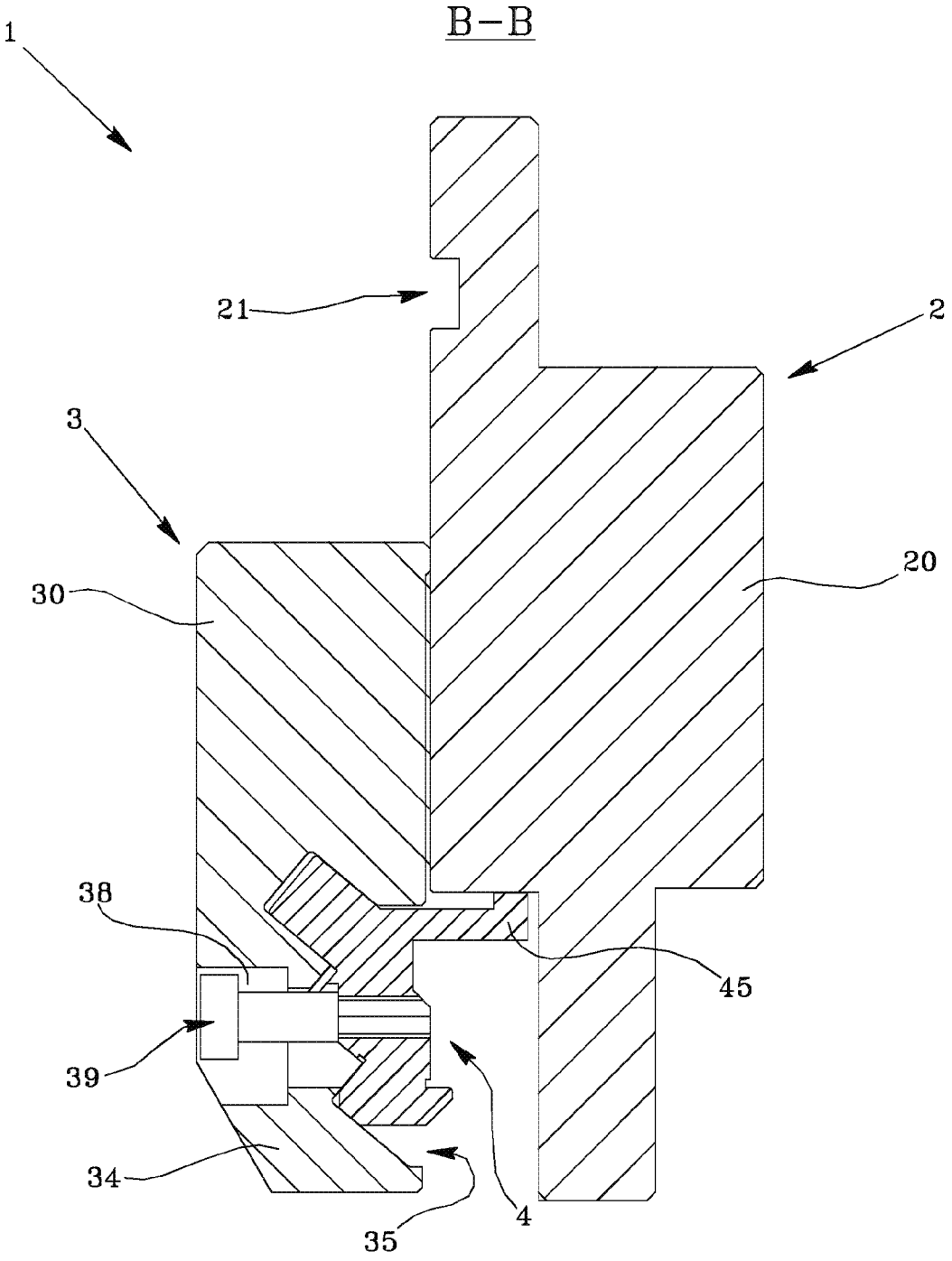
FIG. 4 is a sectional side view, along a vertical plane B-B, of the locking device according to the invention.
Figure 5:
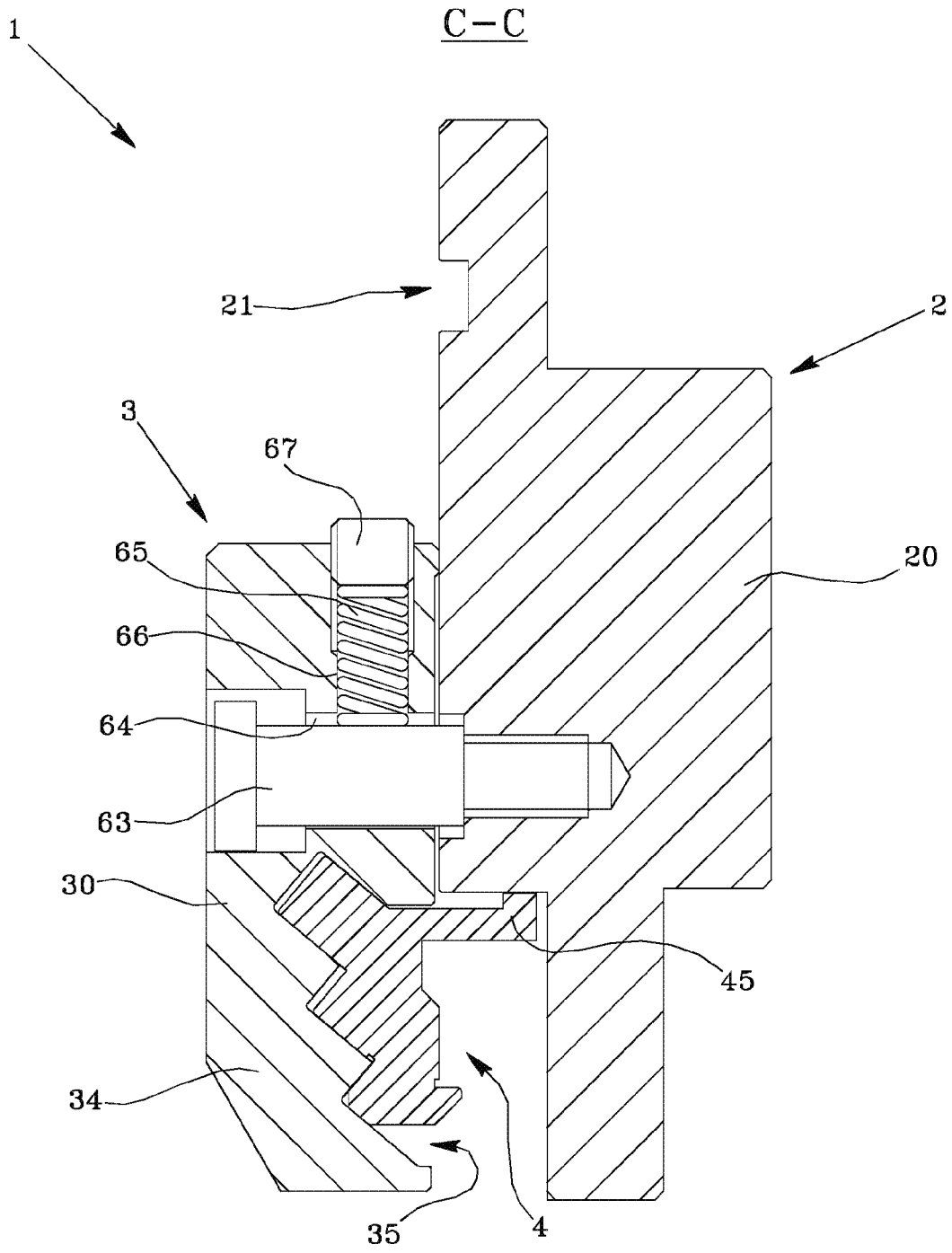
FIG. 5 is a sectional side view, along a vertical plane C-C, of the locking device according to the invention.
Figure 6:
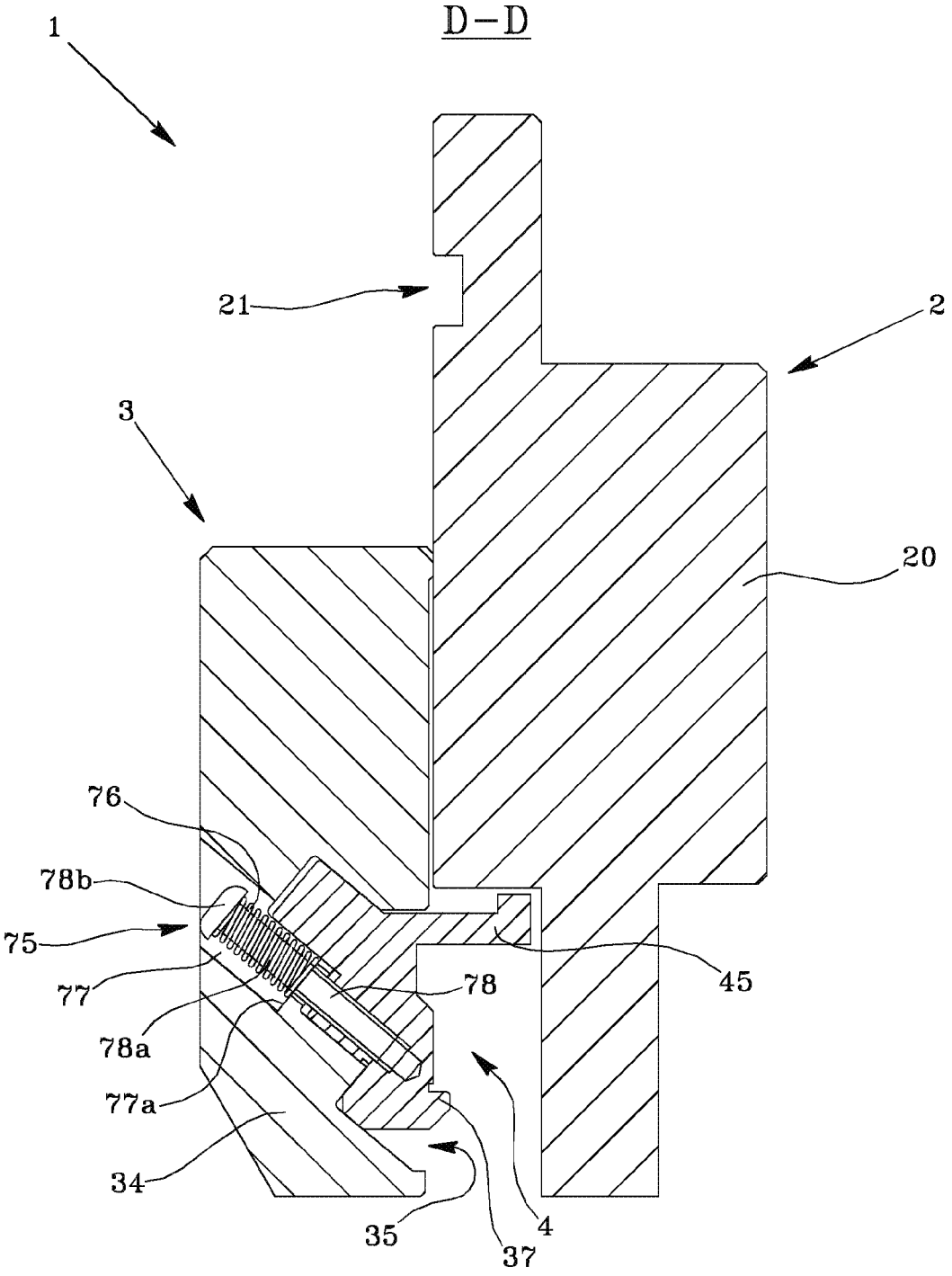
FIG. 6 is a sectional side view, along a vertical plane D-D, of the locking device according to the invention.
Figure 7B:
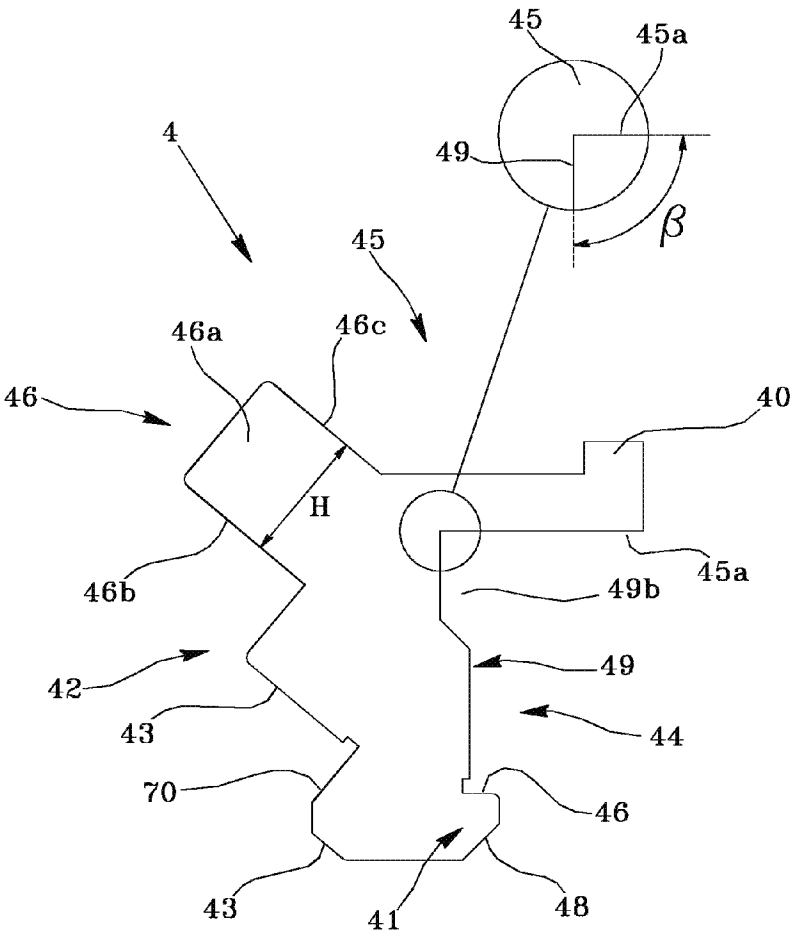
Figure 7A:
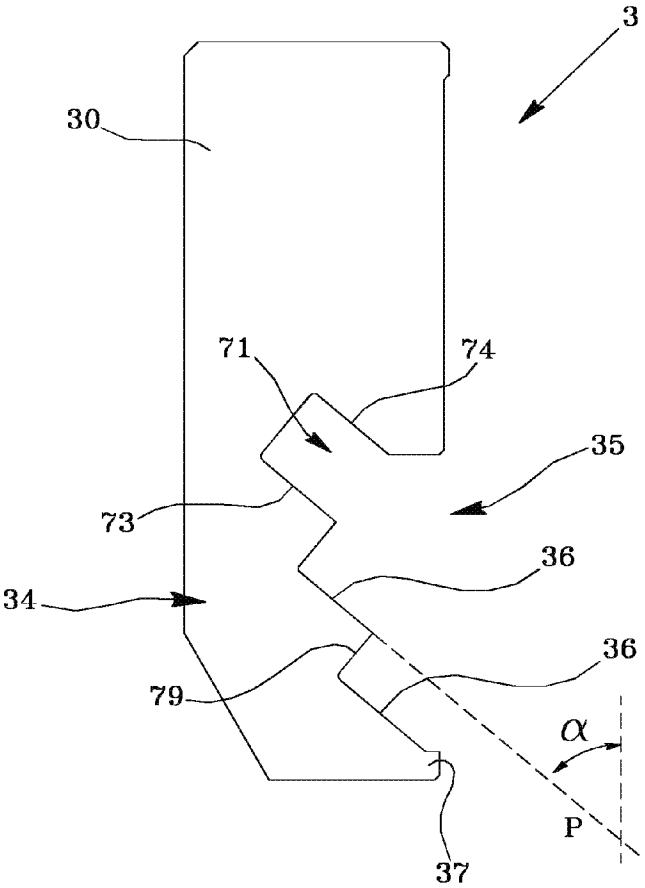
Figure 10:
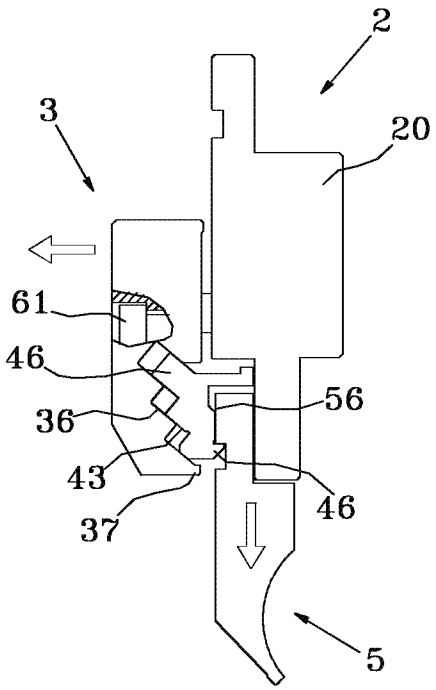
Figure 9B:
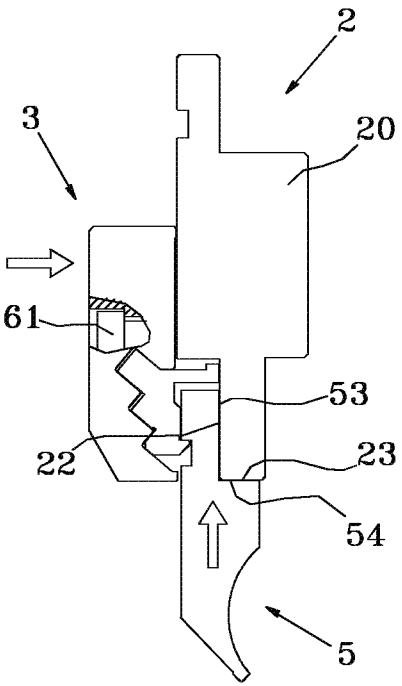
Figure 9A:
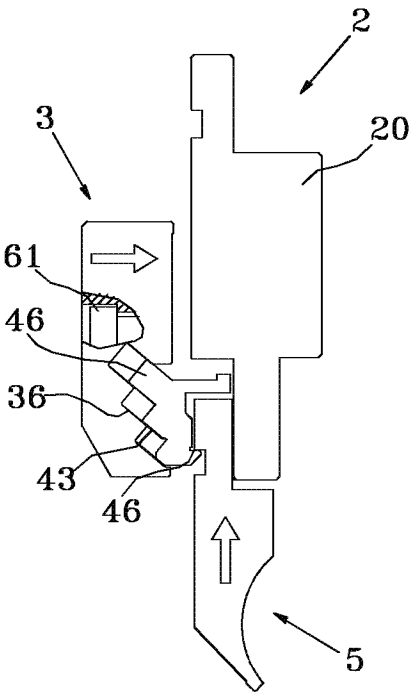

FIG. 7*a* is a sectional side view of the second jaw of the device according to the invention;

FIG. 7*b* is a sectional side view of the safety hook of the device according to the invention;

FIGS. 8*a* to 8*d* are respectively side views showing the steps of insertion of a tool into locking device;

FIGS. 9*a* and 9*b* are respectively side views showing the steps of clamping of the jaws of the locking device;

FIG. 10 is a lateral view that shows the step of release of the jaws of the locking device;

FIGS. 11*a* to 11*d* are respectively side views showing the steps of extraction of a tool from the locking device;

FIG. 12 is a side view showing a shank of a tool of known type.

DETAILED DESCRIPTION OF THE INVENTION

With reference to the accompanying figures, the number 1 indicates a locking device for locking tools in a press brake, as a whole.

This device can be used to constrain a tool, indicated with 5, produced with a monolithic body or divided into a plurality of sub-multiples.

A press brake or bending press, not shown in the accompanying figures, generally comprises a bottom bed defining a fixed plane on which to rest the sheet metal and carrying a bending die according to the profile of which the sheet metal is to be bent.

An upper beam is supported so that it can move towards and away from the bed, along a substantially vertical plane. Movement is generated by hydraulic, mechanical or electrical actuator means, which provide the necessary force for the deformation operation. The beam carries integral therewith a bending tool adapted to cooperate with the die to give the sheet the desired shape. The locking device 1 can be associated with a beam of a press brake to lock one or more tools 5 with respect thereto.

In the present description, with reference to the locking device, the terms vertical and horizontal shall be used to refer to its position in use in a press brake. In particular, the term vertical indicates a direction parallel to the direction in which the upper crossbeam of the press slides.

The tool 5, in conformity with the prior art, consists of a body whose lower end is structured to cooperate with the resting surface of the die and an upper portion that defines a shank 51 of the locking device 1.

On at least one face of the shank there is obtained a groove 52 having a substantially C-shaped cross section, which enables the tool 5 to be maintained suspended when the locking device is released for replacement operations, and said tool 5 to be taken to the correct operating position when the locking device is clamped.

The device 1 comprises a first jaw 2 and a second jaw 3 movable towards and away from each other and at least one safety hook 4 interposed between said first and said second jaw.

Said safety hook, is provided at the base with a retaining tooth 41 structured to be housed in the groove 52 of the shank 51 and adapted to maintain the tool suspended when the locking device is released, for example at the end of the insertion step and at the start of the removal step thereof.

In a preferred embodiment, the locking device 1 is provided with one or more safety hooks 4 arranged longitudinally side by side, i.e. along the direction of extension of the beam.

The first jaw comprises a body 20 in turn associable with the upper beam of the press by means of a shank 21 placed at the top. Said body is provided with a sliding surface 22 facing the second jaw 3 that extends on a plane substantially vertical and parallel to the longitudinal extension of the upper beam. On said sliding surface 22 there can slide the face 53 of the shank 51 opposite the face 56 on which the groove 52 is obtained. At the base of said sliding surface 22 there is defined a contact surface 23 that extends in a direction substantially orthogonal thereto and adapted to contact a step 54 that extends orthogonally from the face 53 of the shank 51.

The second jaw 3 is associated slidingly with the first jaw 2, to move towards and away from it, through actuator means 6 of known type.

In a preferred embodiment, said actuator means comprise at least one control pin 61. Said control pin 61 passes through a hole 31 obtained in the second jaw 3 and is screwed, with the possibility of a limited partial screwing or unscrewing, in a threaded hole 26 in the first jaw 2. The control pin 61 also comprises a head 62, housed in a seat 33 obtained on the outer face of the second jaw 3, which prevents the pin 61 both from slipping out of this latter and from exerting thrust on said jaw by means of a contact surface in the seat 33.

By acting with a specific tool on the control pin 61 it is possible to translate the second jaw 3 towards the first jaw 2 to clamp the tool 5 in the locking device or, vice versa, to move it away from the first to release and extract the tool.

Guide pins 63, housed in through holes 64 obtained in the first jaw, act as guide for sliding of the second jaw 3 towards or away from the first jaw 2.

To facilitate movement of the jaws 2, 3 away from each other, said guide pins are preferably associated with springs or the like interposed between the inner faces of said jaws.

In an alternative variant, not illustrated, said manual actuator means can be replaced with pneumatic or hydraulic actuators well known in the art.

In a preferred variant of the invention, the hole 31 and/or the holes 64 have a larger dimension with respect to the respective control pin 61 and guide pins 63.

Said holes 31 and/or 64 can have a circular or slotted profile. In this way the second jaw 3 can undergo slight vertical movements with respect to the first jaw 2. Preferably, at least one elastic means 65 is housed in the second jaw 3 to maintain it raised so that the guide pins 63 remain in contact with the lower edge of the respective holes 64.

In a preferred embodiment, in the second jaw 3 there is obtained at least one seat 66 into which a spring 65 is inserted. The seat 66 extends until intercepting the hole 64 so that one end of the spring 65 contacts the guide pin 63. The opposite end 66*a* of the seat 66 is closed by a cover 67 that acts as abutment for the spring 65. Preferably, the cover 67 comprises a threaded element that can be screwed or unscrewed in the seat 66 to compress the spring 65 to a greater or lesser extent and thus vary its preload.

When the jaws 2, 3 are clamped by means of the control pin 61, the second jaw 3 is able to adjust vertically so as to offset any differences in the dimension of the height of the shank 51 of the tool 5 with respect to the nominal value. The springs 65 that act on the guide pins 61 prevent excessive clearance of the second jaw 3 with respect to the guide pins 63 during the clamping step.

The second jaw 3 comprises a body 30 with a lower appendage 34 adapted to cooperate with the safety hook 4 during the various operating steps of the locking device.

According to a preferred embodiment, on an inner side 35 of the appendage 34 there is obtained at least one thrust surface 36 that operates resting slidingly on a corresponding rest surface 43 obtained on an outer side 42 of the safety hook 4.

In practice, said surfaces 36, 43 slide substantially parallel along a thrust plane P, sloping in the opposite direction to the first jaw 2, i.e. viewed from the front as in the accompanying figures, from the bottom upwards and from right to left, by an angle of between 30° and 60°.

In a preferred embodiment said thrust plane P is sloping by an angle of between 45° and 50°.

When the second jaw 3 is clamped towards the first jaw 2, the rest surface 43 thus slides on the thrust surface 36 causing translation of the safety hook 4, which, as will be clearer below, enables the tool 5 to rest thereagainst.

In a preferred embodiment, on the appendage 34 of the second jaw 3 there are obtained a plurality of parallel thrust surfaces 36 that lie on the same number of thrust planes P. Likewise, on the outer side 42 of the safety hook 4 there are obtained a same number of rest surfaces 43 each of which resting slidingly on a thrust surface 36.

This enables the total sliding and thrust surface between the second jaw 3 and the safety hook 4 to be increased, regardless of a very limited horizontal extension of the safety hook 4, which has a positive influence on the horizontal dimensions of the locking device 1.

Moreover, this configuration of the safety hook 4 is effective to also substantially reduce the longitudinal extension, i.e. the width, if observed from the front, with the advantage of ensuring greater safety also when changing tools divided into several parts or sub-multiples of small dimensions, as will be clearer below.

A larger total thrust surface also enables a reduction in the contact pressure, reducing wear on the surfaces and the force to be applied to the actuator means 6 to clamp the jaws.

Finally, the staggered position of the rest surfaces 43 enables the thrust to be distributed more evenly along the vertical extension of safety hook 4.

Advantageously, the thrust surfaces 36 and rest surfaces 43 can be between two and six in number.

In the preferred variant of embodiment, the number of thrust surfaces 36 and of rest surfaces 43 is respectively three.

The travel of the safety hook 4 on the second jaw 3 is limited by at least one stop surface 79 preferably obtained on the inner side of said second jaw. Said stop surface 79 is for example a transverse surface with one or more thrust surfaces 36.

This stop surface 79 is contacted with the safety hook 4 in the end of travel position. For this purpose, the safety hook 4, on the outer side 42, can have a stop surface 70 parallel to that of the second jaw.

Moreover, or in alternative, on the cantilever portion there can be provided a stop tooth 40 adapted to contact a face 24 of the first jaw 2 facing the cantilever portion 45 when the safety hook is in the position of maximum height.

The safety hook 4 is also provided with a guide element 46 adapted to guide the safety hook in the translation along the thrust plane P. More in detail, the guide element 46 prevents undesirable rotations of the insert both during the steps of clamping and release of the jaws, and during removal of the tool. The guide element 46, in practice, maintains the thrust surfaces 36 and the rest surfaces 43 substantially in contact.

In a preferred variant the guide element 46 comprises at least one slider 46*a* sliding in a seat 71 obtained in the second jaw 3. More in detail, the seat 71 is obtained on the inner side 35 of the second jaw. The slider 46*a* is preferably produced in once piece with the safety hook 4.

In a possible embodiment, the slider 46*a* has at least one first guide surface 46*b* adapted to slide resting on a corresponding guide surface 73 obtained on the second jaw 3. Preferably, the slider 46*a* is provided with a second guide surface 46*c* adapted to slide resting on a corresponding guide surface 74 obtained on the second jaw 3.

Advantageously, the guide surface 73 of the second jaw 3 also acts as thrust surface 36, just as the guide surface 46*b* of the slider acts as rest surface.

The two guide surfaces 46*b*, 46*c* of the slider 46 are parallel with each other and parallel to the thrust plane P. The height H of the slider 46*a* is substantially the same as the distance between the first and the second guide surface 46*b*, 46*c*. In practice, when the slider is housed in the seat 71 the safety hook 4 can only translate along a direction parallel to the thrust plane P.

The guide element 46 can have a width (observing the device from the front) the same as, less than or even greater than the width of the safety hook 4.

From the base of the second jaw 3, and specifically of the appendage 34, there extends, towards the first jaw 2, a stop foot 37 on which the safety hook 4 can rest when the jaws 2, 3 are released, and which defines a lower stop position of this safety hook 4.

At the top the safety hook 4 is provided with a cantilever portion 45 that projects towards the first jaw 2 and that is above the top 57 of the shank 51.

The cantilever portion 45 has a lower face 45*a* sloping towards the first jaw 2, i.e. viewed from the front as in the accompany figures, from the bottom upwards and from left to right, by an angle β of between 80° and 110° with respect to the vertical abutment plane 49 of the safety hook 4.

An angle that has been found to be optimal is of around 90°.

The retaining tooth 41 of the safety hook 4 defines an engaging surface 46 against which there rests a face 55 of the groove 52 obtained in the shank 51.

The aforesaid engaging surface 46 extends in a substantially orthogonal direction with respect to a vertical abutment plane 49 that is located on an inner side 44 of the safety hook 4.

In the upper part, the vertical abutment plane 49 has a flare 49*b* that reduces the surface of the abutment plane that contacts the shank 51. This enables the point in which the clamping force is applied on the shank 51 to be translated downwards, thereby limiting the possibility of the tool 5 undergoing slight rotations when subject to strain during us.

On an opposite side with respect to the engaging surface 46, the retaining tooth has a chamfer 48 that acts as a guide to facilitate insertion of the shank 51 between the first jaw 2 and the safety hook 4.

In a preferred embodiment, in the appendage 34 of the second jaw 3 there is obtained at least one seat 38, preferably in the shape of a through slot extending vertically, inserted into which is a through positioning pin 39, the end of which is fixed to the safety hook 4. The function of said positioning pin 39 is to constrain the safety hook 4 to a translation along a longitudinal direction, i.e. parallel to the extension of the crossbeam.

In a variant of the invention, the locking device is also provided with retaining means 75 that act on the safety hook 4 to slow its downward movement in the direction parallel to the thrust plane P.

In practice, the retaining means 75 apply to the safety hook a force with a component opposing the force of gravity that normally causes the safety hook 4 to descend towards the stop foot 37.

Advantageously, as will be better illustrated below, these retaining means facilitate removal of the tool 5 from the jaws 2, 3 when these are released.

According to a preferred embodiment, the retaining means comprise an elastic means 76 that exerts its force along a direction parallel to the thrust plane P. Said elastic means is, for example, a coil spring or the like. More in detail, the coil spring 76 can be housed in a seat 77 obtained in the second jaw 3.

A pin 78 constrained to the safety hook has a portion 78*a* housed inside the seat 77. The spring 76 rests on a head 78*b* of the pin 78 that transmits the elastic force to the safety hook 4. In the variant illustrated, the spring 76 is arranged around the pin 78 between the head 78*b* and a contact surface 77*a* of the seat 77.

Operation of the locking device of the invention is as follows.

The devices enables insertion and removal of the tool 5 with a vertical movement and removal thereof with a combined rotation and translation movement.

FIGS. 8*a*-8*d* represent in sequence the steps of insertion of the shank 51 of a tool 5 between the two jaws of the locking device 1.

The first jaw 2 and the second jaw are maintained space apart by the elastic means that, when the control pin 61 is rotated in the release condition, cause the second jaw 3 to move away from the first jaw 2.

Figure 8D:
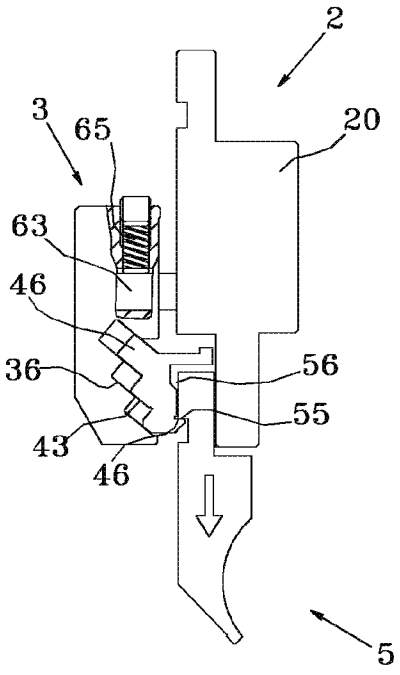
Figure 8C:
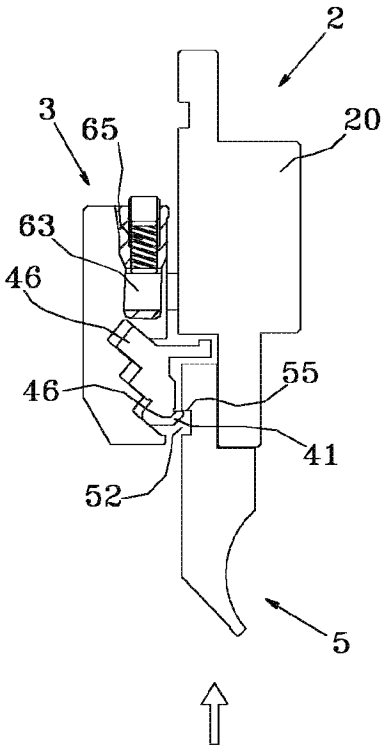
Figure 8B:
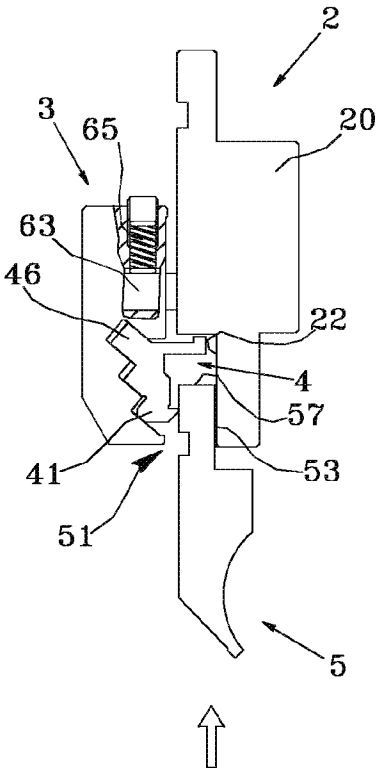
Figure 8A:
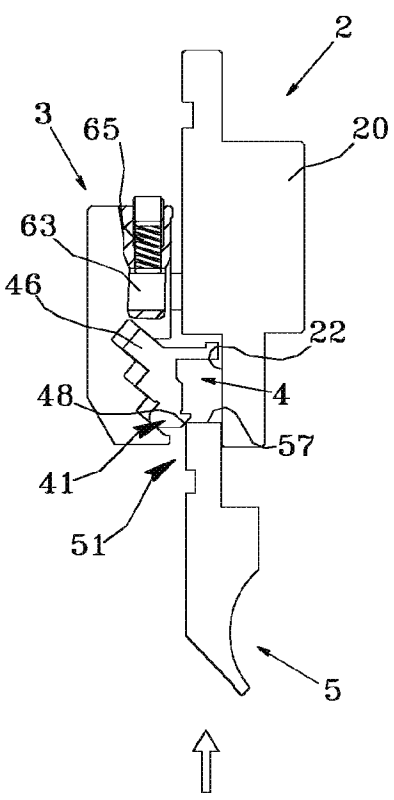

The tool 5 is inserted manually by exerting thereon a vertical thrust from the bottom upwards as indicated by the arrow in FIG. 8*a*.

The top 57 of the shank, contacting the chamfer 48 of the retaining tooth 41, pushes the safety hook 4 that, guided by the guide element 46, slides upwards parallel to the thrust plane P resting on the thrust surfaces 36 of the second jaw 3.

During translation the retaining tooth 41 moves back towards the second jaw 3 until the top 57 of the shank moves beyond the chamfer 48 of the retaining tooth 41.

After moving beyond this point the surface 56 of the shank slides upwards in contact with the retaining tooth 41 (FIG. 8*b*).

Once the face 55 of the groove 52 is at a greater height than the engaging surface 46, the weight of the safety hook 4 causes this to descend slightly until the lower face 45*a* of the cantilever portion 45 contacts the top 57 of the shank. During descent the safety hook 4 also translates towards the first jaw 2 causing the retaining tooth 41 to enter the groove 52. (FIG. 8*c*)

At this point if the tool is released it will descend slightly until the face 55 of the groove 52 is resting on the engaging surface 46 of the retaining tooth 41, as can be seen in FIG. 8*d*. In this condition the tool 5 is maintained stably in the locking device. In fact, the weight of the tool 5 causes the safety hook 4 to be drawn downwards and, at the same time, by virtue of the slope of the thrust surfaces 36, towards the face 56 of the shank 51.

FIGS. 9*a* and 9*b* represent in sequence the steps of clamping of the two jaws.

The control pin 61 is rotated in the screwing direction in the first jaw 2 so as to push, along a substantially horizontal direction, the second jaw 3 towards the first jaw 2. Simultaneously the thrust surfaces 36 of the second jaw press on the rest surfaces 43 of the safety hook 4 that, due to the slope of the thrust plane P on which the aforesaid surfaces lie, is pushed simultaneously upwards and towards the first jaw 2, drawing the tool 5 (FIG. 9*a*). It should be noted that in this condition the safety hook 4 cannot rotate as it is maintained by the guide element 46.

When the step 54 and the face 53 of the tool 5 are respectively in contact with the contact surface 23 and the sliding surface 22 of the first jaw 2, the tool is clamped and ready for use (FIG. 9*b*).

During clamping the second jaw can move slightly with respect to the guide pins 63 and to the control pin 61 so as to adjust, once clamped, with respect to the first jaw at a height that ensures perfect contact between the face 53 of the tool and the contact surface 23 of the first jaw.

With reference to FIG. 10 there is represented the step of release of the two jaws for removal of the tool 5.

The control pin 61 is rotated in the direction of unscrewing from the first jaw 1 so as to enable translation of the second jaw 3 away from the first jaw 2. In this condition the weight of the tool 5, discharged onto the engaging surface 46 of the retaining tooth 41, causes a gradual downward sliding of the safety hook 4 until the lower end thereof is resting against the stop foot 37 of the second jaw 3.

As occurs during the step of insertion of the tool, the slope of the thrust surfaces 36 and of the related rest surfaces 43 ensure that the safety hook 4, during descent, remains pushed towards the face 56 of the shank 51 so that the retaining tooth 41 remains engaged in the groove 52.

Figure 11D:
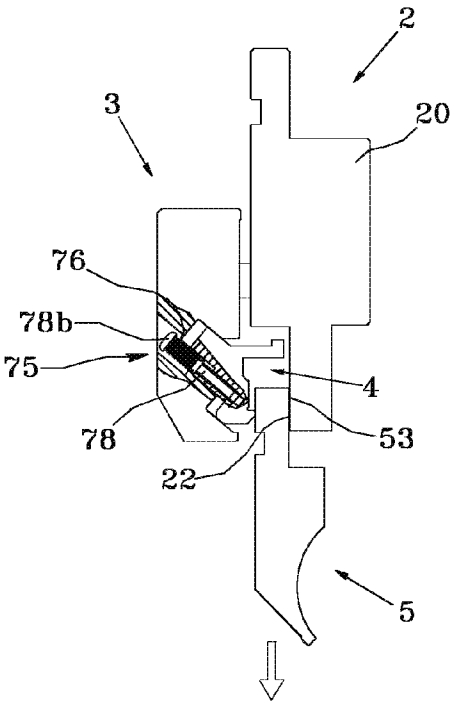
Figure 11C:
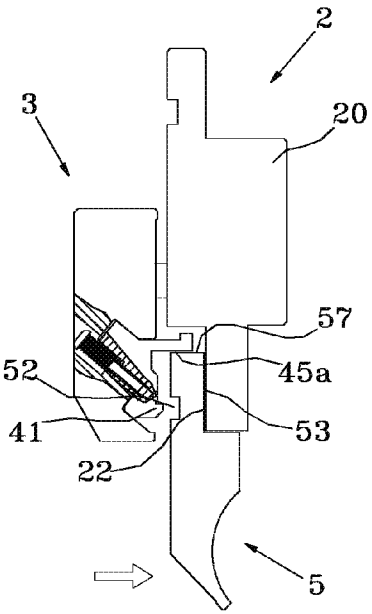
Figure 11B:
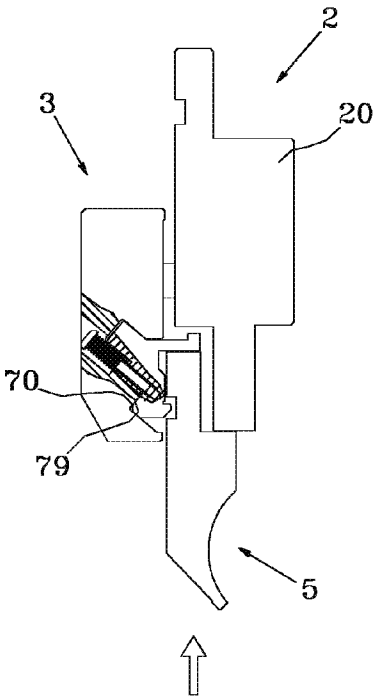
Figure 11A:
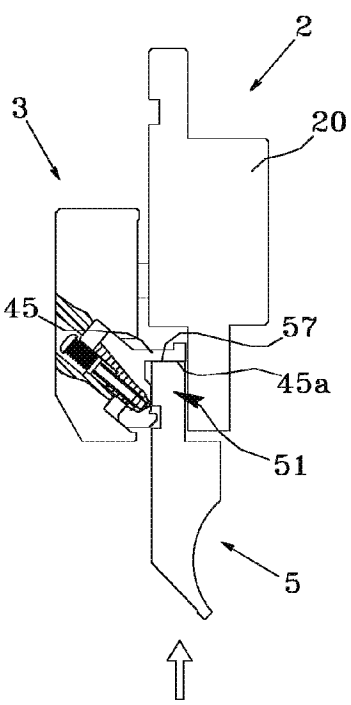

For extraction of the tool 5, as illustrated in FIGS. 11*a*-11*d* it is necessary to exert thereon an upward vertical thrust until the top 57 of the shank 51 reaches and rests on the lower face 45*a* of the cantilever portion 45 (FIG. 11*a*).

From this position, continuing to push upwards, the top 57 of the shank generates a thrust on the cantilever portion 45, which in turn draws the safety hook 4 upwards, always in a direction parallel to the thrust plane P.

After reaching a position of maximum height, in which the stop surfaces 79 and 70, respectively of the second jaw 3 and of the safety hook 4, are in contact with each other, the safety hook 4 stops its travel (FIG. 10*b*).

At this point it is necessary to apply a direct force on the tool 5 towards the second jaw 2, as shown by the arrow in FIG. 11*c*. In this way, the top 57 of the shank 51 slides along the lower face 45*a* of the cantilever portion 45 until the face 53 of the shank 51 stops on the sliding surface 22 of the first jaw 2.

In this position, the retaining tooth 41 exits from the groove 52 of the shank 51.

From this position it is sufficient to draw the tool 5 rapidly downwards so that the shank descends without the retaining tooth 41 interfering with the groove 52 of the shank 51 (FIG. 10*d*). Once said groove 52 is no longer in the area of action of the retaining tooth 41 it is sufficient to exert a downward pulling action to remove the tool 5 completely from the jaws.

Advantageously, during this step the retaining means 75 contribute to slowing the descent of the safety hook 4 preventing the retaining tooth 41 from re-entering the groove 52 of the shank before passing beyond it.

More in detail, during descent of the safety hook 4, the head 78*b* of the pin 78 compresses the spring 76, which slows the travel of the safety hook 4.

As will be clear from the description above, the present invention solves the problems that affect prior art devices achieving the set objects.

In detail the locking device enables operations for installation and/or removal of one or more tools to be performed simply, rapidly and safely. In fact, the particular structure of the safety hook 4 together with that of the second jaw 3 ensures that the tool 5 is maintained suspended between the jaws both before clamping and after release thereof.

In particular, the structure of the safety hook 4 and of the second jaw 3 ensure that any accidental impacts or knocks sustained by the tool cannot cause the release thereof. In fact, even if the tool is rotated with respect to the shank, the safety hook 4, thanks to fact that it can slide freely and to its weight, tends always to return to the lowered position in which it is moved towards the first jaw 2 and in which the retaining tooth 41 is able to engage the groove 52 of the shank.

The locking device of the present invention also has a mechanically sturdy, simple and reliable structure.

The present invention, as described and illustrated, may be subject to various modifications and variants, all of which fall within the scope of the invention; furthermore, all the details may be replaced with other technically equivalent elements.

The invention claimed is:

1. A locking device for locking tools in a press brake, comprising:

a first jaw and a second jaw, movable towards and away from each other, and at least one safety hook interposed between said first jaw and said second jaw provided with a retaining tooth inserted into a groove defined in a shank of a tool, wherein on an inner side of said second jaw facing the first jaw there are a plurality of thrust surfaces cooperating with, while resting slidingly against, a same number of corresponding rest surfaces on an outer side of the safety hook, said thrust surfaces and said rest surfaces lying substantially parallel along corresponding thrust planes sloping in a direction to the first jaw by an angle ($\alpha$) of between 30° and 60° with respect to a vertical plane, said thrust planes being parallel to and staggered from one another along a substantially vertical direction.

2. The locking device according to claim 1, wherein said angle ($\alpha$) is between 45° and 50°.

3. The locking device according to claim 1, wherein said safety hook has a guide element that guides the safety hook along said thrust plane.

4. The locking device according to claim 3, wherein said guide element comprises a slider sliding in a seat on an inner side of the second jaw.

5. The locking device according to claim 4, wherein the slider has at least a first guide surface sliding on a corresponding guide surface on the second jaw, said guide surface also being a thrust surface of the safety hook.

6. The locking device according to claim 1, wherein said thrust surfaces and said rest surfaces are between two and six in number.

7. The locking device according to claim 1, wherein the safety hook has a cantilever portion, projecting towards the first jaw, provided with a lower face sloping from a bottom of the safety hook upwards in a direction of the first jaw by an angle ($\beta$) of between 80° and 110° with respect to a vertical abutment plane located on an inner side of the safety hook.

8. The locking device according to claim 1, wherein in the second jaw there is at least one seat into which is inserted a through positioning pin, and one end of the through positioning pin is fixed to the safety hook.

9. The locking device according to claim 1, further comprising retaining means that act on the safety hook to slow downward movement of the safety hook away from the second jaw.

10. The locking device according to claim 9, wherein said retaining means comprise an elastic means housed in a seat in the second jaw adapted to exert a force along a direction parallel to the thrust plane.

11. The locking device according to claim 10, wherein said elastic means rest on a head of a pin integral with the safety hook and housed at least partly in the seat.

12. The locking device according to claim 1, further comprising guide pins housed in through holes in the second jaw adapted to guide said second jaw towards or away from the first jaw, said through holes having a larger dimension with respect to the guide pins so that the second jaw can sustain vertical movements with respect to the first jaw.

13. The locking device according to claim 12, wherein at least one elastic means housed in the second jaw acts on the guide pins to maintain said second jaw in a raised position in which the guide pins contact lower edges of the respective holes.

14. The locking device according to claim 13, wherein said elastic means comprise a spring inserted in a seat that intercepts the hole of the guide pin, one end of the spring contacting the guide pin.

15. A locking device for locking tools in a press brake, comprising:

a first jaw and a second jaw, movable towards and away from each other, and at least one safety hook interposed between said first jaw and said second jaw, the at least one safety hook having a retaining tooth inserted into a groove in a shank of a tool, wherein on an inner side of said second jaw facing the first jaw there is at least one thrust surface adapted to cooperate with, while resting slidingly against, at least one corresponding rest surface obtained on an outer side of the safety hook, said thrust surface and said rest surface lying substantially parallel along a thrust plane sloping in a direction to the first jaw by an angle ($\alpha$) of between 45° and 50° with respect to a vertical plane.

16. A locking device for locking tools in a press brake, comprising:

a first jaw and a second jaw, movable towards and away from each other, and at least one safety hook interposed between said first jaw and said second jaw, the at least one safety hook having a retaining tooth inserted into a groove in a shank of a tool, wherein on an inner side of said second jaw facing the first jaw there is at least one thrust surface adapted to cooperate with, while resting slidingly against, at least one corresponding rest surface obtained on an outer side of the safety hook, said thrust surface and said rest surface lying substantially parallel along a thrust plane sloping in a direction to the first jaw by an angle ($\alpha$) of between 30° and 60° with respect to a vertical plane, and the at least one safety hook has a guide element that guides the safety hook along said thrust plane.

* * * * *